United States Patent [19]

Losert

[11] Patent Number: 4,469,383

[45] Date of Patent: Sep. 4, 1984

[54] REFRIGERATOR CABINET AND METHOD OF CONSTRUCTION

[75] Inventor: Gerhard K. Losert, Louisville, Ky.

[73] Assignee: General Electric Company, Louisville, Ky.

[21] Appl. No.: 380,190

[22] Filed: May 20, 1982

[51] Int. Cl.[3] ..... A47B 81/00; E06B 7/16

[52] U.S. Cl. ..... 312/296; 49/478; 49/487; 312/214

[58] Field of Search ..... 312/296, 214; 109/75; 49/478, 487

[56] References Cited

U.S. PATENT DOCUMENTS

| | | | |
|---|---|---|---|
| 2,958,912 | 11/1960 | Bower et al. | 49/478 |
| 3,022,550 | 2/1962 | Beckett et al. | 312/296 |
| 3,075,258 | 1/1963 | Petkwitz | 49/478 |
| 3,138,833 | 6/1964 | Neuman | 312/296 |
| 3,241,198 | 3/1966 | Baermann | 49/478 |
| 3,248,159 | 4/1966 | Hall | 312/296 |
| 3,259,446 | 7/1966 | Harle et al. | 312/296 |
| 3,359,053 | 12/1967 | Hagendoorn | 312/296 |

*Primary Examiner*—William E. Lyddane
*Assistant Examiner*—Thomas A. Rendos
*Attorney, Agent, or Firm*—Frederick P. Weidner; Radford M. Reams

[57] ABSTRACT

A refrigerator cabinet and method of constructing the same including a storage compartment having an access opening surrounded by a face portion comprising an area composed of magnetic material. A door is hingedly mounted on the cabinet for closing the access opening and the door comprises an outer metal panel having an inwardly turned flange extending about the periphery thereof and a plastic inner panel having a flange with a peripheral edge portion overlying and joined to the flange of the outer panel, the panels having thermal insulation therebetween. A sealing gasket is mounted on the door adjacent the peripheral edge and includes a base portion overlying the peripheral edge of the inner panel and a cabinet engaging portion integrally joined to the base portion and includes a magnetic means attracted to the area of magnetic material and provides the sole means for holding the door in a closed position. The base portion of the sealing gasket has a first section secured to the door and includes a downwardly projecting front seal, a downwardly projecting rear seal spaced from the front seal, and an upwardly curved surface joining the rear and front seals. There is also included an upwardly depending hollow member above the rear seal that has rear vertical surface and a curved surface between the rear seal and the rear vertical surface of the hollow member. The base portion has a second section spaced from and joined to the first section comprising a web that is spaced from and overlies the hollow member and the second section has a downwardly extending projection contacting the inner panel. A retainer member overlying and shaped to accommodate the upwardly depending hollow member is secured to the door by fasteners through the plastic inner panel flange and the inwardly turned flange of the outer door panel.

8 Claims, 3 Drawing Figures

REFRIGERATOR CABINET AND METHOD OF CONSTRUCTION

BACKGROUND OF THE INVENTION

The present invention relates to refrigerator and freezer cabinets and their method of construction and is more particularly concerned with a cabinet including an improved magnetic gasket construction for preventing sweating of the cabinet door in the vicinity of the sealing gaset and provides easy assembly of the door.

A well known type of magnetic gasket designed not only to seal the space between the door and the cabinet face but also to maintain the door in a closed position by attraction of a magnetic means carried by the gasket with a magnetic metallic area on the face of the cabinet comprises a base portion including means for securing one longitudinal edge of the base portion to the door and a tubular portion containing the magnetic means. The gasket is an extruded resilient material such as rubber, polyvinylchloride or the like. The flexibility or resiliency of various portions of the gasket is controlled by varying the cross-sectional thicknesses thereof in order that each portion may perform the desired function or functions. For example, the base portion which is secured along its outer edge to the door assembly, must be sufficiently thick and rigid so that its inner free edge is normally in engagement with the door surface and maintains an insulating dead air space beneath the gasket base portion when the door is in a closed position. However, the gasket must be sufficiently flexible so that it can be folded back during assembly of the door and gasket to provide access to the fastening or anchoring means employed to secure the one edge of the gasket to the door. Within the range of manufacturing tolerances, it is possible to so design the base portion that the inner or free edge will maintain contact with the inner door panel. However, in certain applications involving either a relatively large door or large differences between the cabinet interior and ambient temperatures, the door may bow to such an extent that the free or unanchored edge of the gasket pulls away from the adjacent portion of the inner door panel, thereby permitting the free circulation of the refrigerated air into the space beneath the gasket where it contacts the gasket retaining means. The resultant heat transfer through this area to the outer door panel results in sweating on the outer surface of the door. A typical construction and gasket to solve this problem is described in U.S. Pat. No. 3,359,053, assigned to the same assignee as the present invention.

Special skills and sometimes a lot of rework is required to overcome the inherent gasket mounting problems to make certain that the gasket is properly positioned on the cabinet door to assure good sealing characteristics. As is often the case, such as in the construction described in U.S. Pat. No. 3,359,053 referred to above, the gasket is pinched causing the thin outer edge of the gasket to be distorted. In addition, there is a tendency for the gasket to roll causing the front edge to be turned under when the fasteners are tightened. The gasket also has a tendency to be caught between the inner door and the retainer, resulting in gasket distortion.

By this invention, there is provided a refrigerator cabinet and method of constructing the cabinet which includes a gasket configuration which overcomes the above-mentioned gasket mounting problems.

SUMMARY OF THE INVENTION

A refrigerator cabinet and method of constructing the same including a storage compartment having an access opening surrounded by a face portion comprising an area composed of magnetic material. A door is hingedly mounted on the cabinet for closing the access opening and the door comprises an outer metal panel having an inwardly turned flange extending about the periphery thereof and a plastic inner panel having a flange with a peripheral edge portion overlying and joined to the flange, the panels having thermal insulation therebetween. A sealing gasket is mounted on the door adjacent the peripheral edges and includes a base portion overlying th peripheral edge of the inner panels and a cabinet engaging portion integrally joined to the base portion and includes a magnetic means attracted to the area of magnetic material and provides the sole means for holding the door in a closed position. The base portion of the sealing gasket has a first section secured to the door and includes a downwardly projecting front seal, a downwardly projecting rear seal spaced from the front seal, and an upwardly curved surface joining the rear and front seals. There is also included an upwardly depending hollow member above the rear seal that has a rear vertical surface and a curved surface between the rear seal and the rear vertical surface of the hollow member. The base portion has a second section spaced from and joined to the first section comprising a web that is spaced from and overlies the hollow member and the second section has a downwardly extending projection contacting the inner panel. A retainer member overlying and shaped to accommodate the upwardly depending hollow member is secured to the door by fasteners through the plastic inner panel flange and the inwardly turned flange of the outer door panel.

DESCRIPTION OF THE PREFERRED EMBODIMENT

Figure 2:
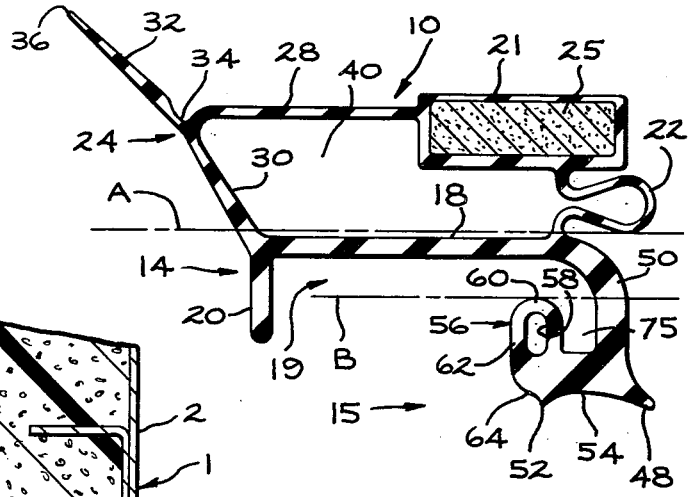
FIG. 2 is a lateral cross-section view of the magnetic gasket of the present invention in its free or "as extruded" configuration.
Figure 1:
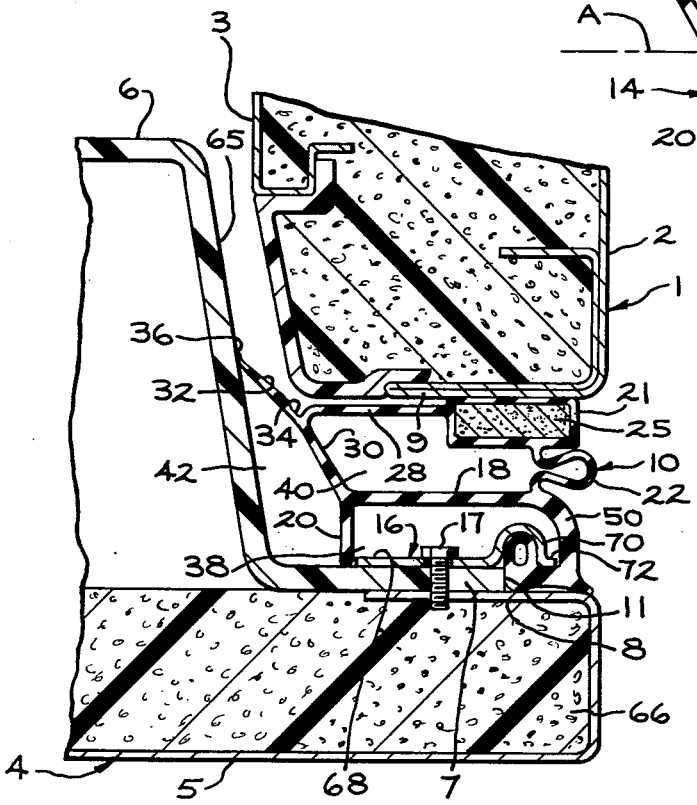
FIG. 1 is a lateral cross-section view through a portion of a refrigerator cabinet embodying the magnetic gasket seal of the present invention.

Referring to FIGS. 1 and 2 of the drawing, there is shown a refrigerator including a cabinet member 1 comprisng an outer metal shell 2 and a liner 3, the liner forming a storage compartment within the cabinet. A door 4 for closing the access opening to the storage compartment is hingedly supported along one vertical edge thereof by means of hinges (not shown). The door comprises an outer panel 5 of sheet metal and an inner panel 6 of plastic sheet material. Inner panel 6 has a flange with a peripheral edge portion 7 which overlaps a portion of an inwardly extending flange 8 on the outer panel 5. The space between the face of the cabinet as represented by an inwardly extending flange 9 on the cabinet shell 2 and the door is sealed and held in a closed position by means of a magnetic gasket generally indicated by the numeral 10.

Figure 3:
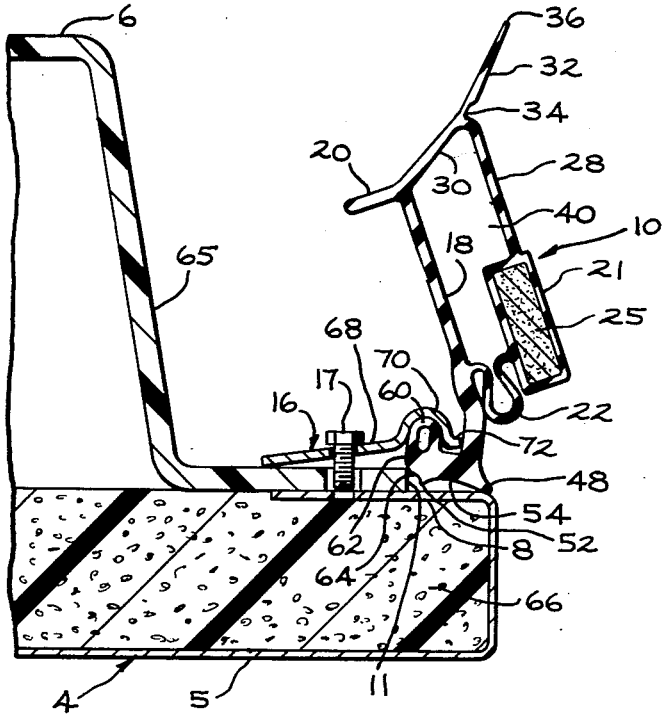
FIG. 3 is a lateral cross-section view through a portion of a refrigerator door embodying the magnetic gasket seal of the present invention and showing partial assembly of the refrigerator cabinet.

The gasket 10 comprising a resilient material such as rubber, polyvinylchloride or the like includes a base portion generally indicated in FIG. 2 as 14 and is that portion of gasket 10 below line A and a cabinet engaging portion generally indicated as 24, which is that portion above line A. The base portion 14 has a first section generally designated 15 and is that section below line B in FIG. 2 and a second section generally designated 19 between lines A and B. The first section 15 of the base portion 14 is secured to the flange 8 by means of a retainer strip 16 extending substantially the full length of the gasket. The retainer strip 16 is secured directly to the flange 8 by means of a plurality of screw fasteners 17 extending through the retainer strip, the peripheral edge portion 7, and flange 8 to join those elements together. It will be noted that the first section 15 comprises the sole means for securing the gasket to the door. The base portion 14 is of generally rectangular cross-section, as viewed in FIG. 1. There is a front curved member 50, a downwardly extending rear member 20 with a horizontal web member 18 between members 50 and 20. These members together with the door 4 form a rectangular cavity or dead air space 38 when the gasket is attached to the door. It will be noted that the downwardly extending projection 20 thereof is in engagement with the inner door panel 6 when fully assembled. The front curved member 50 is sufficiently flexible so that the portion of gasket 10 above line B can be folded or flexed away from the inner surface of the door during assembly of the refrigerator door and gasket in order to provide access for driving the fasteners 17 (FIG. 3 ).

The cabinet engaging portion 24 of gasket 10 has a rectangular cavity portion 21 secured at the front end to the base portion 14 by a U-shaped structure 22 which provides limited movement between the cavity portion 21 and the base portion 14. A magnet 25 of the well known type comprising metallic magnetic particles embedded in the strip of plastic material is contained within the cavity portion 21 which registers with the magnetic metal face portion or flange 9 of the cabinet, the magnetic attraction between the magnet 25 and the flange 9 serving as the sole means for holding the door in its closed position (FIG. 1).

The cabinet engaging portion 24 of gasket 10 is of a relatively thin cross-section as compared with the base portion 14 and has a first leg 28 parallel to and spaced from the base portion web member 18 and a second leg 30 joining the first leg 28 and the base portion web member 18. By this arrangement, the U-shaped structure 22 joins the rectangular cavity portion 21 to the base portion 14 at the front thereof, and legs 28 and 30 join the rear portion of the rectangular cavity portion 21 to the base portion 14. With this arrangement, there is formed a rectangular dead air or insulating space 40. There is also provided a flexible flap 32 which is joined to the cabinet engaging portion 24 at the junction 34 of legs 28 and 30 and has a free end 36 that is is contact with the inner door panel 6 as seen in FIG. 1. This arrangement forms a dead air or insulating space 42 (FIG. 1). With this gasket arrangement, it will be noted that there is in effect three separate dead air insulating spaces 38, 40 and 42 provided by cooperation of the gasket 10 with the door 4 and the cabinet 1. These dead air spaces provide for good thermal insulation to prevent the passage of air between the inside of the cabinet and the outside surrounding ambient air.

With particular reference to FIG. 2, the "as extruded" gasket has at the forward end of the base portion 14 a first section 15 which has a front seal 48 which projects downwardly and outwardly from the curved front member 50 and there is a rear seal 52 spaced from the front seal 48 and is also downwardly projecting. An upwardly curved surface 54 joins the rear seal 52 to the front seal 48. The first section 15 also has an upwardly depending hollow member 56 located above the rear seal 52 and has a cavity 58, a dome-shaped upper wall 60 and a rear vertical surface 62. There is a curved surface 64 connecting the rear seal 52 and the rear vertical surface 62 of the hollow member 56. The hollow member 56 is spaced rearward of the front curved member 50, thus providing a space 65 therebetween. Utilization of the structural arrangement described above will now be discussed.

In constructing the refrigerator door 4, the outer metal panel 5 is formed to provide a inwardly turned flange 8. The inner door panel 6 is formed of plastic material and has a flange with a peripheral edge portion 7 with a terminal end 11 and a portion 65 directed upwardly away from the flange. The peripheral edge portion 7 of the inner door panel is placed on a portion of the inwardly turned flange 8 of the outer door panel. Insulation material 66 is placed between the outer door panel and inner door panel either before attaching one panel to the other or afterwards. The retainer strip 16 has a flat section 68 and an upwardly curved section 70, the inside dimension of which conforms with the dome-shaped upper wall 60 of the hollow member 56. The flat section 68 is placed on the peripheral edge portion 7 of the inner door panel loosely, as shown in FIG. 3; that is, the fasteners 17 have not been tightened and this allows for the positioning of the base portion 14 of the sealing gasket under the retainer strip and specifically the hollow member 56, as shown in FIG. 3. After insertion of the gasket in this manner, the portion of gasket 10 above line B of FIG. 2 is flexed upwardly away from the retainer strip to allow access to the fasteners 17, as shown in FIG. 3. The fasteners are then tightened to secure the outer door panel, inner door panel, retainer strip and base portion of the sealing gasket together. During this operation, it will be noted specifically in FIG. 3 that the curved surface 64 guides the base portion of the gasket to clear the terminal end 11 of peripheral edge portion 7 such that upon completion of tightening the fasteners a portion of the vertical surface 62 and the curved surface 64 are adjacent the terminal end 11 of the inner door panel peripheral flange 7. In prior art gasket configurations that did not have such a curved surface, the gasket was often caught on the terminal end 11 of the peripheral edge portion 7 and distorted upon tightening of the fasteners.

When flat section 68 of the retainer strip 16 is flat against the upper surface of peripheral edge portion 7, the forward terminal end 72 of the retainer strip is located in the space 75 between the hollow member 56 and the front curved member 50 and tends to flatten the upwardly curved surface 54 and press the seals 48 and 52 tightly against the flange 8. With this construction then, there is a constant tension force applied to the seals 48 and 52, tending to draw the front seal 48 and rear seal 52 together and thus provide an excellent seal area between the seals 48 and 52 and the flange 8 of the outer panel 5.

The reason for making member 56 of the gasket hollow is so that it is somewhat flexible and the dome-shaped upper wall 60 thereof will conform to and fill up the space inside the upwardly curved section 70 of the retainer strip 16. This helps prevent the gasket from rolling during assembly of the door which in turn prevents it from being deformed during tightening of the fasteners 17.

Once the fasteners 17 have been tightened, the portion of the gasket above line B of FIG. 2 is released and the gasket assumes it normal functional position as shown in FIG. 1. The door then is completely assembled and may now be hingedly mounted to the cabinet 1 along one edge thereof for closing the access opening of the storage compartment.

While, in accordance with the patent statutes, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A refrigerator cabinet comprising:

a storage compartment having an access opening surrounded by a face portion comprising an area composed of magnetic material;

a door hingedly mounted on said cabinet along one edge thereof for closing said access opening, said door comprising an outer metal panel having an inwardly turned flange extending about the periphery thereof and a plastic inner panel having a flange with a peripheral edge portion and terminal end overlying and joined to said flange, said panels having thermal insulation therebetween;

a sealing gasket of resilient material mounted on said door adjacent the peripheral edges thereof and including a base portion overlying said peripheral edge of said inner panel and a cabinet engaging portion integrally joined to said base portion and including a magnetic means attracted to said area of magnetic material and providing the sole means for holding the door in a closed position, said base portion having;

a first section utilized for sealing engagement and securement to the door comprising, as viewed in lateral cross section, a downwardly projecting front seal and a downwardly projecting rear seal spaced from the front seal and an upwardly curved surface joining the rear seal and the front seal, an upwardly depending hollow member the center of which is in vertical alignment and above the rear seal and having a rear vertical surface spaced from the center, and a curved surface between the rear seal and the rear vertical surface of the hollow member with a portion of each said surface being adjacent the terminal end of the plastic inner panel and the rear seal is spaced remote from the terminal end, a second section spaced from and joined to the first section comprising a web member that is spaced from and overlies the hollow member, said second section having a downwardly extending projection contacting the inner panel, and a retainer member overlying and shaped to accommodate the upwardly depending hollow member, said retainer member being secured to the door by fasteners through the plastic inner panel peripheral edge portion and the inwardly turned flange of the outer door panel.

2. The refrigerator cabinet of claim 1 wherein the cabinet engaging portion is of a relatively thin cross-section as compared with said base portion.

3. The refrigerator cabinet of claim 1 wherein the cabinet engaging portion is resiliently joined to the second section of the base portion and is movable with the second section from a first position covering the retainer member to a raised position uncovering the retainer member to allow access to the fasteners.

4. The refrigerator cabinet of claim 1 wherein the cabinet engaging portion includes a rectangular cavity portion to receive therein a strip of magnet material to provide the magnetic means.

5. The refrigerator cabinet of claim 4 wherein the rectangular cavity portion is joined at its front end to the base portion by a flexible U-shaped structure and at the rear end by a first leg parallel and spaced from the base portion web member and a second leg joining the first leg and the base portion web member.

6. The refrigerator cabinet of claim 5 wherein the inner panel has a portion directed upwardly away from the flange and the cabinet engaging portion of the gasket has a flap extending from the junction of the second leg and first leg such that it contacts said upwardly directed portion of the inner panel.

7. A method of constructing a refrigerator cabinet comprising:

forming a storage compartment from magnetic sheet metal having an access opening surrounded by a face portion;

forming a metal outer door panel with an inwardly turned flange extending about the periphery thereof and a plastic inner door panel having a flange with a peripheral edge portion having a terminal end;

forming a sealing gasket of resilient material which includes a base portion and a cabinet engaging portion with a magnetic means receiving cavity, said portions being integrally joined to each other, said base portion having, a first section utilized for sealing engagement and securement to the door comprising, as viewed in lateral cross-section, a downwardly projecting front seal and a downwardly projecting rear seal spaced from the front seal and an upwardly curved surface joining the rear seal and the front seal, an upwardly depending hollow member the center of which is in vertical alignment and above the rear seal and having a rear vertical surface spaced from the center, and a curved surface between the rear seal and the rear vertical surface of the hollow member, a second section spaced from and joined to the first section comprising a web member that is spaced from and overlies the hollow member, said second section having a downwardly extending projection contacting the inner panel, placing magnetic means in the magnetic means receiving cavity of the cabinet engaging portion of the sealing gasket;

placing thermal insulation between the outer door panel and inner door panel;

placing the peripheral edge portion of the inner door panel on a portion of the inwardly turned flange of the outer door panel;

placing a retainer strip on the peripheral edge portion of the inner door panel;

loosely attaching the outer door panel, inner door panel and retainer strip together by fasteners;

positioning the first section of the base portion of the sealing gasket under the retainer strip;

flexing the cabinet engaging portion and second section of the base portion of the sealing gasket upwardly away from the retainer strip to allow access to the fasteners;

tightening the fasteners to secure the outer door panel, inner door panel, retainer strip and base portion of the sealing gasket together such that a portion of the vertical surface and curved surface of the hollow member are adjacent the terminal end of the inner door panel peripheral edge portion and the rear seal is spaced remote from the terminal end; and hingedly mounting the assembled door on said cabinet along one edge thereof for closing said access opening of the storage compartment.

8. The method of claim 7 wherein the upwardly curved surface between the front seal and rear seal is deformed by the retainer strip to provide tension force between the front and rear seals upon tightening the fasteners to secure the outer door panel, inner door panel, retainer strip and base portion of the sealing gasket together.

* * * * *